United States Patent [19]

Masaki

[11] 4,217,869

[45] Aug. 19, 1980

[54] METHOD OF CONTROLLING THE AIR-FUEL RATIO OF AN AIR-FUEL MIXTURE PROVIDED FOR AN INTERNAL COMBUSTION ENGINE AND A SYSTEM FOR EXECUTING THE METHOD

[75] Inventor: Kenji Masaki, Yokohama, Japan

[73] Assignee: Nissan Motor Company, Limited, Yokohama, Japan

[21] Appl. No.: 836,752

[22] Filed: Sep. 26, 1977

[30] Foreign Application Priority Data

Sep. 27, 1976 [JP] Japan ..... 51/115540

[51] Int. Cl.[2] ..... F02M 7/00; F02M 31/00

[52] U.S. Cl. ..... 123/438; 123/568

[58] Field of Search ..... 123/119 EC, 3, 119 A, 123/119 E, 122 G, 122 AC

[56] References Cited

U.S. PATENT DOCUMENTS

| | | | |
|---|---|---|---|
| 2,355,090 | 8/1944 | Love | 123/119 EC |
| 3,825,239 | 7/1974 | Rice | 123/119 EC |
| 4,030,464 | 6/1977 | Yamaguchi | 123/119 A |
| 4,050,425 | 9/1977 | Holleboom | 123/119 EC |
| 4,112,876 | 9/1978 | Mentschel | 123/3 |
| 4,134,375 | 1/1979 | Koseki | 123/119 EC |
| 4,153,021 | 5/1979 | Hahori | 123/119 EC |

*Primary Examiner*—Ronald H. Lazarus

*Attorney, Agent, or Firm*—Lane, Aitken & Ziems

[57] ABSTRACT

A part of an engine air-fuel mixture is admitted from the intake passageway into a space and is burned to produce combustion gases for sensing the air-fuel ratio of the admitted air-fuel mixture and for controlling the air-fuel ratio of an engine air-fuel mixture in accordance with the sensed air-fuel ratio and exhaust gases resulting from the combustion gases are fed into the intake passageway.

26 Claims, 5 Drawing Figures

METHOD OF CONTROLLING THE AIR-FUEL RATIO OF AN AIR-FUEL MIXTURE PROVIDED FOR AN INTERNAL COMBUSTION ENGINE AND A SYSTEM FOR EXECUTING THE METHOD

BACKGROUND OF THE INVENTION

1. Field of the Invention

The present invention relates generally to a method of and a system for controlling the air-fuel ratio of an air-fuel mixture to be burned in an internal combustion engine to a desired air-fuel ratio and particularly to a method and a system of this type by which the time required from provision of the air-fuel mixture to detection of a parameter representative of a function of the air-fuel ratio of the air-fuel mixture is reduced.

2. Description of the Prior Art

As is well known in the art, a technique has been recently developed which precisely controls the air-fuel ratio of an air-fuel mixture, fed into a combustion chamber of an internal combustion engine, by sensing with an exhaust gas sensor a parameter representative of a function of the concentration of a specific component in exhaust gases of the engine which component has a character corresponding to the air-fuel ratio of an air-fuel mixture burned in the engine, and by controlling the supply of fuel to the engine in accordance with an output signal representative of the sensed concentration of the specific component. This technique is applied to a carburetor as well as an electronically controlled fuel injection device. However, a carburetor has a general character that the air-fuel ratio variations between the products are fairly large. The air-fuel ratio variations between the products result in the exhaust emission variations between engines and is an obstacle to a strict control of the exhaust emission.

Thus, the accuracy of control and the inspection of the component parts of carburetors have been recently strikingly intensified so that the production cost of the carburetors is steadily increased.

However, even if the accuracy of control and the inspection of the component parts of the carburetors are strikingly increased in this manner, the air-fuel ratio variations between the products is intolerably great. On the other hand, for electronically controlling a carburetor so that the air-fuel ratio characteristics are uniform between the products, it is necessary to specially devise the way of controlling, the controlling parts, the electronic circuit and so on. This complicates the construction. Accordingly, it is a great problem of the electronically controlled carburetor which is to be solved to completely absorb the air-fuel ratio variations between the products.

However, when the above-mentioned technique is applied to a carburetor in which the air-fuel ratio variations between the products are large, the air-fuel ratio variations between the products are almost absorbed, and the air-fuel ratio is accurately controlled to a desired value in a relatively easy manner when the engine is in an operating condition in which the load varies narrowly. However, when the engine is in, for example, a rapid acceleration, the air-fuel ratio of an air-fuel mixture provided by the carburetor has already varied when a sensor provided in the exhaust system has sensed the concentration of a specific component in engine exhaust gases. As a result, since a control circuit generates an incorrect control signal, the confusion of control has occurred or the correction of control has been very much delayed.

This phenomenon is due to a delay by flowing of the air-fuel mixture in the carburetor and the intake passageway, a delay by the engine operations of intake, compression, explosion and exhaust, a delay by flowing of the engine exhaust gases from the engine to the sensor in the exhaust gas passageway, a delay in sensing of the concentration of the specific component by the sensor, and so on. From provision of the air-fuel mixture to detection of the concentration of the specific component, there is a substantial delay of nearly 0.2 seconds or 200 milliseconds at the vehicle speed of about 50 Km/h, in the case of, for example, an internal combustion engine for use in an automobile.

Also in the case of an internal combustion engine of an electronically controlled fuel injection type, a substantial delay is present which is shorter than the case of the engine including the carburetor mentioned above by several tens of milliseconds which correspond to the distance between the position of provision of a carburetor and the position of fuel injection in the intake passageway in the above-mentioned condition since fuel is injected at a position adjacent to the intake valve in the case of the engine of the fuel injection type.

As a solution to this problem, a system for controlling an air-fuel ratio of an air-fuel mixture provided for an engine has been proposed in which a part of the air-fuel mixture is extracted from the intake passageway into a combustion gas generator, the extracted air-fuel mixture is burned in the combustion gas generator to form combustion gases therein, a sensor senses a parameter representative of a function of the concentration of a specific component in the combustion gases which concentration is closely related to the air-fuel ratio of the extracted air-fuel mixture, and the air-fuel ratio of an air-fuel mixture provided for the engine is controlled to a desired value in accordance with the sensed parameter.

When the system proposed is applied to a carburetor, even if the carburetor is such that the air-fuel ratio variations between the products are present, the air-fuel ratio variations are absorbed so that the air-fuel ratio is corrected to a uniform desired value and even when the engine is in an operating condition in which load varies violently, the air-fuel ratio is satisfactorily corrected with a minimized delay.

However, in the conventional system, the resultant gases of the combustion gases are conducted into the exhaust gas passageway of the engine. As a result, the conventional system requires measures for maintaining the pressure of the combustion gases at a tolerably high level. This is to make combustion of the extracted air-fuel mixture possible in spite of a high back pressure in the exhaust gas passageway and to at all times maintain stable combustion of the extracted air-fuel mixture without being influenced by variations in the pressure of engine exhaust gases due to variations in engine load. Furthermore, when the extracted air-fuel mixture is not burned in the combustion gas generator due to a malfunction, or the like, the unburned air-fuel mixture is discharged to the atmosphere through the exhaust gas passageway to contaminate the atmosphere and at times the unburned air-fuel mixture causes a extraordinary combustion in the exhaust gas passageway to make the engine dangerous.

SUMMARY OF THE INVENTION

It is, therefore, an object of the invention to provide a method and a system for controlling the air-fuel ratio of an air-fuel mixture provided for an engine which fail to require the above-mentioned measures and to exert bad influences as mentioned above on the engine and the atmosphere and which are free from a problem in safety.

This object is accomplished by feeding the resultant gases of the combustion gases into the intake passageway by employing the pressure differential therein or a pump in place of feeding into the exhaust gas passageway.

BRIEF DESCRIPTION OF THE DRAWINGS

This and other features and advantages of the invention will become more apparent from the following detailed description taken in connection with the accompanying drawings in which.

DESCRIPTION OF THE SPECIFIC EMBODIMENTS

Figure 1:
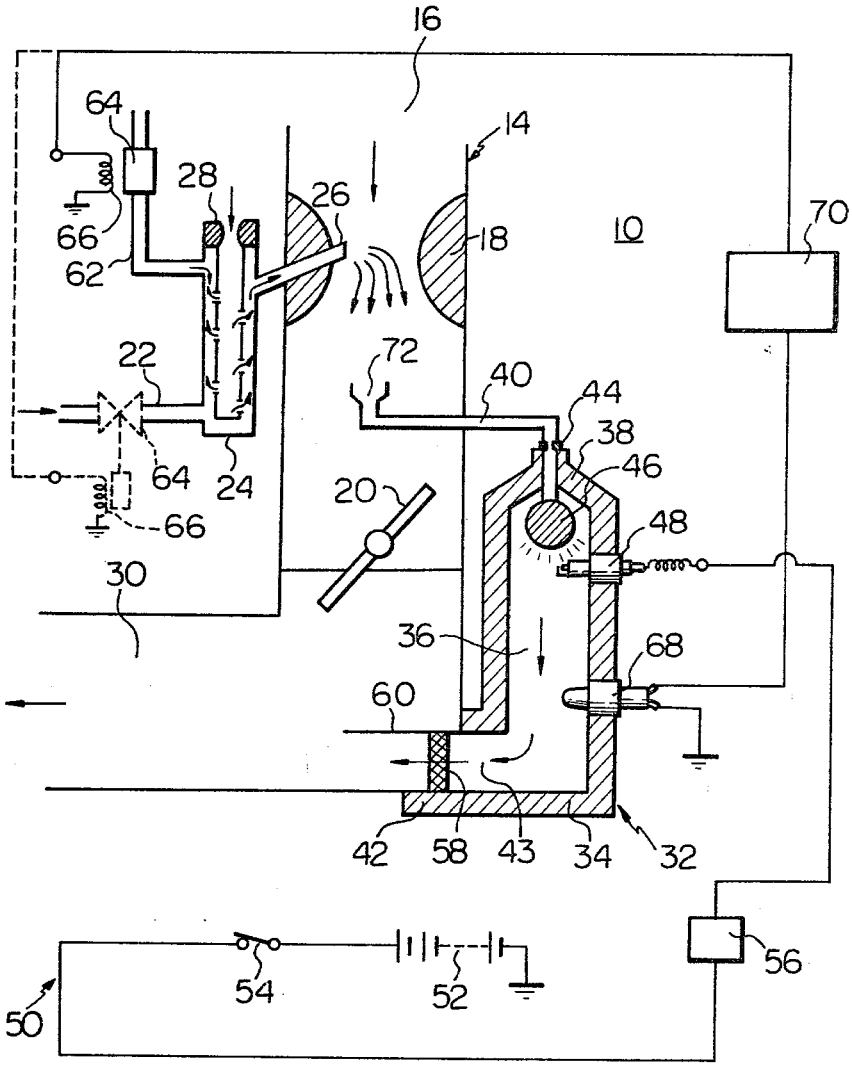
FIG. 1 is a schematic view of a first preferred embodiment of an air-fuel ratio control system according to the invention.

Referring to FIG. 1 of the drawings, there is shown a first preferred embodiment of an air-fuel ratio control system according to the invention. The air-fuel ratio control system, generally designated by the reference numeral 10, is combined with an internal combustion engine (not shown) including an air-fuel mixture forming device 14 which is a carburetor in this embodiment, and an intake passageway or conduit 16 passing through the carburetor 14. The intake passageway 16 has a venturi 18 formed therein and a throttle valve 20 rotatably mounted therein at a location downstream of the venturi 18. The carburetor 14 has a main fuel passage 22 communicating with a fuel source (not shown). The fuel passage 22 has an air-fuel mixer 24 communicating therewith, and a main fuel nozzle 26 communicating with the air-fuel mixer 24 and opening into the venturi 18. The fuel passage 22 is providing with a main air bleed 28 communicating with the atmosphere and with the air-fuel mixer 24. The intake passageway 16 located downstream of the carburetor 14 forms an intake manifold 30 directly communicating with combustion chamber means (not shown) of the engine 12.

The air-fuel ratio control system 10 comprises a combustion gas generating device 32 which is arranged in proximity to the intake passageway 16 for sensing the air-fuel ratio of an air-fuel mixture formed by the carburetor 14. The combustion gas generator 32 comprises a body or housing 34 defining a combustion or reaction chamber 36. The housing 34 has an upper or upstream portion 38 communicating with the intake passageway 16, located downstream of the venturi 18 and upstream of the throttle valve 20, through an inlet port or a passage or conduit 40 for admitting into the combustion chamber 36 a portion of an air-fuel mixture produced for the engine, and a lower or downstream portion 42 formed with an outlet port or a passage or conduit 43 which communicates with the intake passageway 16 downstream of the throttle valve 20 or with the intake manifold 30. The passage 40 is formed therein with a restriction or restricted orifice 44 for controlling the flow rate of the air-fuel mixture admitted into the combustion gas generator 32.

The reaction chamber 36 is provided therein with a burner 46 which communicates with the passage 40 and serves to inject or scatter the air-fuel mixture from the intake passageway 16 into the reaction chamber 36. As the burner 46, it is proper to employ a burner which has a spherical shape as shown in the drawing and which is made of a porous ceramics, when the air-fuel mixture is a mixture of air and gasoline or petrol. However, it is also possible to employ a burner such as a gas burner which is usually employed.

A spark plug 48 is arranged in the reaction chamber 36 at a location adjacent to the burner 46 for igniting the air-fuel mixture directed from the burner 46 into the reaction chamber 36 to produce combustion gases therein. The spark plug 48 is electrically connected to an electric control circuit 50 including an electric power source 52, an ignition switch 54 and a spark plug energizing device 56 which are connected in series. Although a continous combustion of the air-fuel mixture is maintained in the reaction chamber 36 when once the air-fuel mixture is ignited by energization of the spark plug 48, if the spark plug 48 is energized in synchronism with the ignition timing of the engine or is cyclically repeatedly energized by an independent energizing device, the air-fuel mixture can be again burned even if the flame of the burner 46 disappears by any chance so that the reliability in maintaining the combustion in the reaction chamber 36 is increased.

Flame shutoff or barrier means 58 is provided in the outlet passage 43 for preventing the flame produced in the reaction chamber 36 from being conducted into the intake passageway 16 together with exhaust gases of the combustion chamber 36. The flame barrier means 58 is made of a proper flame barrier material or member.

A heating plate 60 is projected from the housing 34 into the intake passageway 16 to form the outlet passage 43. The heating plate 60 is heated by the exhaust gases emitted from the combustion chamber 36 and heats the air-fuel mixture drawn from the intake passageway 16 into the engine to promote atomization of fuel.

A feedback control section of the system 10 comprises an auxiliary air bleed passage or conduit 62 communicating with the atmosphere and with the air-fuel mixer 24 for admitting atmospheric air thereinto. An electromagnetically operated control valve 64 is operably provided for controlling the degree of opening of the auxiliary air bleed passage 62 to the atmosphere to control the amount of atmospheric air drawn into the intake passageway 16 through the auxiliary air bleed passage 62 and therefore to indirectly control the amount of fuel drawn into the intake passageway 16 through the fuel passage 22. The control valve 64 is provided with a solenoid coil 66 for operating same. The control valve 64 may be provided in the fuel passage 22 for directly controlling the amount of fuel drawn into the intake passageway 16 therethrough, in place of providing it in the auxiliary air bleed passage 62. The control valve 64 may be of an on-off type, a type in which open time and closed time of the control valve 64 are varied by varying the pulse width of a pulse signal applied to the solenoid 66, or a proportional type in which the degree of opening of the control valve 64 is continuously varied in proportion to a control signal applied to the solenoid coil 66.

A sensor 68 is provided in the reaction chamber 36 for sensing the concentration of a specific component of the combustion gases produced therein which concentration is closely related to the air-fuel ratio of the air-fuel mixture fed into the reaction chamber 36. The sensor 68 senses the concentration of the specific component by sensing a parameter such as the partial pressure of the specific component which is representative of a function of the concentration of the specific component. For sensing the air-fuel ratio by sensing the concentration of, for example, oxygen in the combustion gases, an oxygen concentration cell such as a zirconic oxygen sensor may be employed as the sensor 68, for example. The zirconic oxygen sensor, if the temperature of the sensor is, for example, at 300° to 800° C., even if the amount of the combustion gases is extremely small, rapidly and accurately senses whether the concentration of oxygen is higher or lower than a basic value corresponding to a stoichiometric air-fuel ratio, that is, whether the air-fuel mixture formed by the carburetor 14 is leaner or richer than an air-fuel mixture having the stoichiometric air-fuel ratio. As the sensor 68, a sensor can be also employed which has nearly linear output characteristics with respect to the air-fuel ratio of an air-fuel mixture and which has electrodes made of platinum and gold. As a sensor of the linear type, there is also a sensor made of materials such as titanic oxide ($TiO_2$), cobalt monoxide (CoO) and so on as principal ingredients. The former sensor can be employed for the control of an air-fuel ratio in the region thereof below the stoichiometric air-fuel ratio, while the latter sensor for the control of an air-fuel ratio in the region thereof above the stoichiometric air-fuel ratio. The sensor 68 operates even in the presence of an extremely slight quantity of gas if a temperature condition is met.

The sensor 68 is electrically connected to an electric control circuit 70 which is electrically connected to the solenoid coil 66. The control circuit 70 receives from the sensor 68 an output signal representative of the sensed concentration of the specific component of the combustion gases and generates a control or command signal which is applied to the solenoid coil 66 to cause the solenoid coil 66 to control the degree of opening of the control valve 64 in accordance with the sensed concentration of the component.

The air-fuel ratio control system 10 thus described is operated in the following manner.

The air-fuel mixture formed in a portion of the intake passageway 16 is drawn therefrom into the passage 40 and is blown off from the burner 46 into the reaction chamber 36 through the passage 40 by the pressure differential between the portions upstream and downstream of the throttle valve 20 which is produced by the air suction operation of the engine. The air-fuel mixture thus blown off is ignited by the spark plug 48 and is continuously burned to produce combustion gases in the combustion chamber 36. Assuming that the sensor 68 is, for example, an oxygen concentration cell, the sensor 68 generates an output signal representing whether the concentration of oxygen in the combustion gases is higher or lower than a standard value corresponding to the stoichiometric air-fuel ratio and therefore whether the burned air-fuel mixture is leaner or richer than an air-fuel mixture having the stoichiometric air-fuel ratio. The control circuit 70 receives the output signal of the sensor 68 and generates a control signal fed to the solenoid coil 66. The control signal causes the solenoid coil 66 to close or open the control valve 64, or reduce or increase the degree of opening of the control valve 64 so that the amount of atmospheric air drawn into the intake passageway 16 through the passage 62 is reduced or increased. As a result, since the amount of fuel drawn from the fuel passage 22 into the intake passageway 16 is increased or reduced by the reduced or increased amount of atmospheric air drawn through the auxiliary air bleed passage 62, the air-fuel mixture formed by the carburetor 14 is made rich or lean. Thus, the air-fuel ratio of the air-fuel mixture is corrected to a desired value in an instant.

It is desirable for maintaining the stability of combustion of the air-fuel mixture at the burner 46 that the flow rate of the air-fuel mixture admitted into the reaction chamber 36 is not varied. When the engine is employed in an automobile and an open end 72 of the passage 40 opens into the intake passageway 16 at a location upstream of the throttle valve 20 as shown in FIG. 1, if the diameter of the orifice 44 is set in such a manner that the pressure differential between the portions upstream and downstream of the throttle valve 20 becomes a critical pressure when the automobile travels at the speed of, for example, 100 km/h, the flow rate of the air-fuel mixture drawn into the combustion chamber 36 becomes constant when the automobile is in a normal travelling condition at a speed below 100 km/h. This flow rate is equal to 2 to 6 percent of the flow rate of the air-fuel mixture sucked into the engine when the automobile travel at the speed of 50 km/h and the flow rate of this degree is enough for detection of the air-fuel ratio of the air-fuel mixture in the combustion gas generator 32.

When the open end 72 of the passage 40 opens into the intake passageway 16 in such a manner as to face the upstream portion thereof as shown in the drawing, the air-fuel mixture can be sufficiently fed into the combustion gas generator 32 by dynamic pressure of the air-fuel mixture passed in the intake passageway 16, even if the degree of opening of the throttle valve 20 is increased so that the pressure differential between the portions upstream and downstream of the throttle valve 20 is reduced.

However, generally in an air-fuel mixture forming device, for example, a carburetor, the air-fuel ratio variations between the products are relatively large in engine low load regions and are not very large in engine medium load and higher regions. Also, since as a matter of purifying engine exhaust gases an engine operating region requiring measures to be taken is the low load region, it is not always necessary to control the air-fuel ratio in engine high load region in which the pressure differential between the portions upstream and downstream of the throttle valve 20 becomes small so that it becomes difficult or impossible to draw the air-fuel mixture into the combustion gas generator 32.

Figure 2:
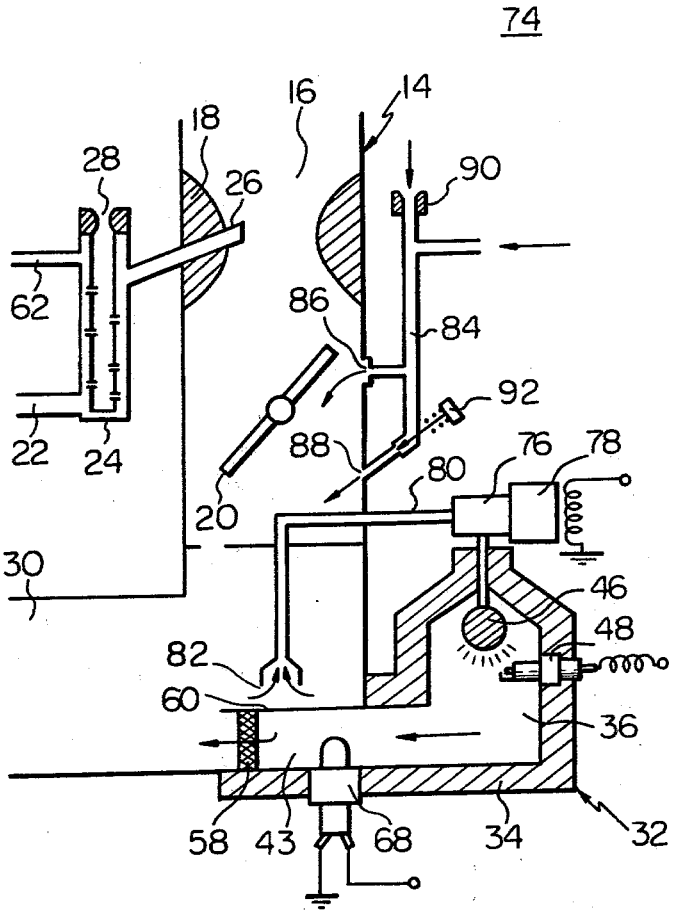
FIG. 2 is a schematic view of a part of a second preferred embodiment of an air-fuel ratio control system according to the invention.

Referring to FIGS. 2, 3, 4 and 5 of the drawings, there are shown second, third, fourth and fifth preferred embodiments of an air-fuel ratio control system according to the invention, respectively. In each of FIGS. 2, 3, 4 and 5, the same component elements as those of the air-fuel ratio control system 10 shown in FIG. 1 are designated by the same reference numerals as those used in FIG. 1, and/or the illustration of the same component elements is omitted for brevity, and with respect to each of FIGS. 2 to 5, the description as to the same component elements is omitted for brevity. The air-fuel ratio control system, generally designated by the reference numeral 74 which is shown in FIG. 2, is characterized in that a pump 76 is employed for admitting a part of the air-fuel mixture in the intake passageway into the combustion gas generator 32. The pump 76 is disposed in a passage or conduit 80 which provides communication between the intake passageway 16 and the combustion chamber 36 of the combustion gas generator 32 for conducting the air-fuel mixture thereinto. The pump 76 is driven by a motor 78, which may be of small size, and draws the air-fuel mixture from the intake passageway 16 through the passage 80 and forces the air-fuel mixture into the combustion chamber 36. In this embodiment, an open end 82 of the passage 80 opens into the intake passageway 16 downstream of the throttle valve 20. The carburetor 14 is provided with a slow speed fuel passage 84 communicating with a fuel source (not shown) and opening through a slow port 86 and an idling port 88 into the intake passageway 16, a slow speed air bleed 90 communicating with the slow speed fuel passage 84 and with the atmosphere, and an idle adjust screw 92, as customary.

The heating plate 60 projecting into the intake passageway 16 is made of a metal having a good heat transfer rate. The open end 82 of the passage 80 is located adjacent to the heating plate for preheating the air-fuel mixture, admitted into the combustion chamber 36, by the heating plate 60 heated by the exhaust gases from the combustion chamber 36 to exert a good influence on the combustion of the air-fuel mixture in the combustion chamber 36.

In a case in which the air-fuel mixture forming device 14 comprises a fuel injection device in place of a carburetor, the open end 82 of the passage 80 is located in an intake passageway downstream of a position in which fuel is injected from the fuel injection device into the intake passageway so that the passage 80 can receive an air-fuel mixture. In this instance, it is desirable that the heating plate 60 is located adjacent to the open end 82 of the passage 80 so that the passage 80 can receive an air-fuel mixture heated by the heating plate 60.

Figure 3:
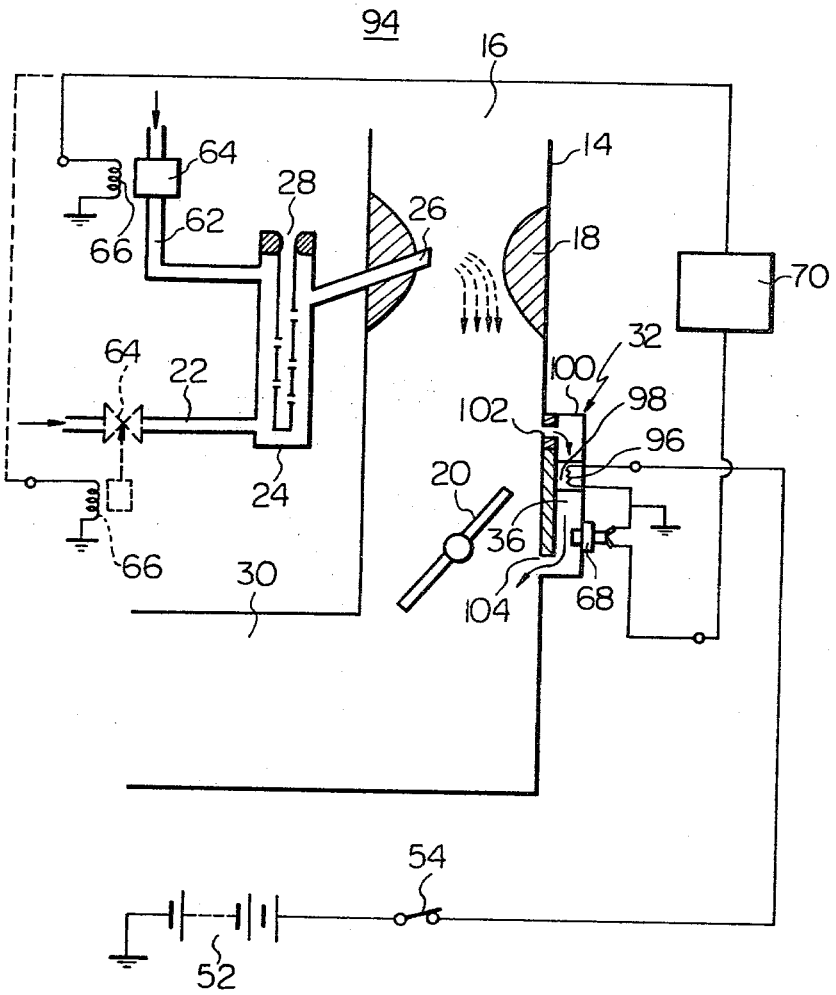
FIG. 3 is a schematic view of a third preferred embodiment of an air-fuel ratio control system according to the invention.

The air-fuel ratio control system, generally designated by the reference numeral 94 which is shown in FIG. 3, is characterized in that an electric heater 96 and a catalyst 98 are provided in the combustion chamber 36 of a housing 100 in place of the spark plug 48 of the system 10 shown in FIG. 1. In this embodiment, the housing 100 is provided with an inlet port or opening 102 communicating with the intake passageway 16 upstream of the throttle valve 20, and an outlet port or opening 104 communicating with the intake passageway 16 downstream of the throttle valve 20. The electric heater 96 is located in the catalyst 98 for heating same to its working temperature. The catalyst 98 is arranged in the housing 100 in such a manner that an air-fuel mixture drawn from the inlet port 102 into the housing 100 is passed through the catalyst 98 to the outlet port 104. The air-fuel mixture drawn into the housing 100, when passed through the catalyst 98 heated by the electric heater 96, is catalytically oxidized and is gasified to form combustion gases in the reaction chamber 36 the concentration of a specific composition of which is sensed by the sensor 68, similarly as mentioned above with respect to the system 10 of FIG. 1. The catalyst 98 may be of extremely small size. Although an oxidation catalyst is normally employed as the catalyst 98, a ternary catalyst can be also employed.

Figure 4:
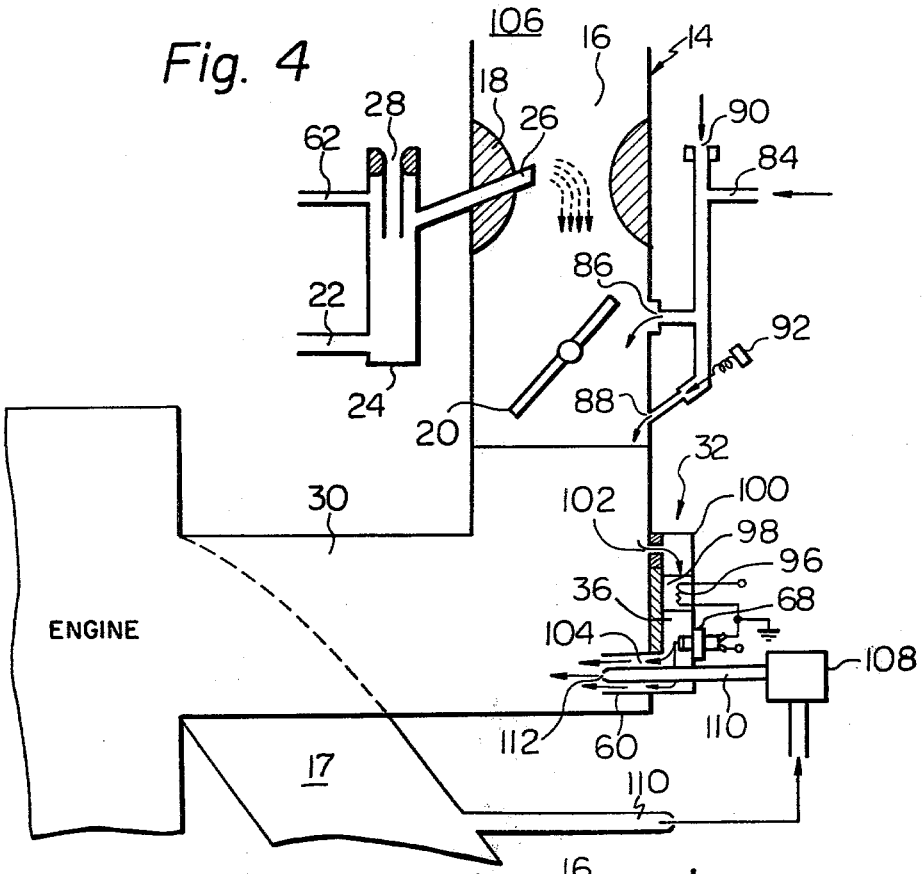
FIG. 4 is a schematic view of a part of a fourth preferred embodiment of an air-fuel ratio control system according to the invention.

The air-fuel ratio control system, generally designated by the reference numeral 106 which is shown in FIG. 4, is characterized in that the impetus of the flow of exhaust gases of the engine recirculated into the intake passageway 16 from an engine exhaust passageway 17 is employed for taking an air-fuel mixture out of the intake passageway 16 into the housing 100. The recirculation is effected by using a pressure differential between induction vacuum in the intake passageway 16 and exhaust pressure in the exhaust passageway 17. In FIG. 4, the same component elements are designated by the same reference numerals as those used in FIG. 3. The housing 100 is arranged in this embodiment in such a manner that the combustion chamber 36 forms a bypass which communicates with two portions of the intake passageway 16 downstream of throttle valve 20 by way of the inlet and outlet ports 102 and 104.

The air-fuel ratio control system 106 is combined with an exhaust gas recirculation (EGR) control system 108 which comprises an EGR passageway or conduit 110 extending from an exhaust gas passageway 17 of the engine and having an outlet end portion 112 extending into the outlet passage 43 of the reaction chamber 36. The outlet portion 112 is concentrically located in the outlet passage 43 in such a manner that it is surrounded by same and that it opens into the intake passageway 16 in the same direction as that of the outlet passage 43. In the air-fuel ratio control system 106 thus constructed and arranged, an air-fuel mixture is admitted from the intake passageway 16 into the reaction chamber 36 through the inlet port 102 and the resultant gases of the combustion gases are forced from the reaction chamber 36 into the intake passageway 16 through the outlet port 104 by an ejector effect or a suction produced by the engine exhaust gases drawn from the outlet portion 112 into the intake passageway 16.

Figure 5:
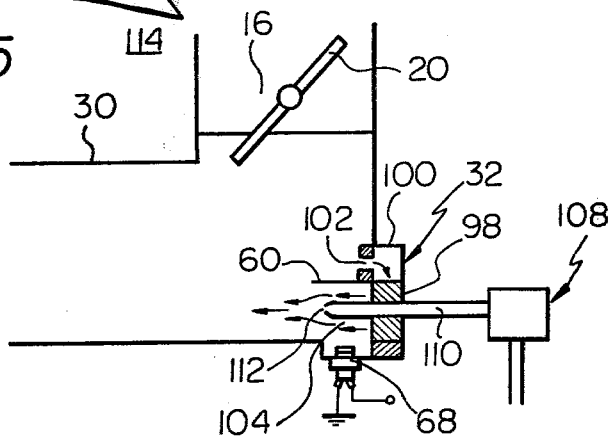
FIG. 5 is a schematic view of a part of a fifth preferred embodiment of an air-fuel ratio control system according to the invention.

The air-fuel ratio control system, generally designated by the reference numeral 114 which is shown in FIG. 5, is characterized in that the outlet portion 112 of the EGR conduit 110 is passed through the catalyst 98 for heating same to its working temperature by heat of the EGR conduit 110 heated by the engine exhaust gases, in place of providing the electric heater 96. In FIG. 5, the same component elements are designated by the same reference numerals as those used in FIG. 4.

As is apparent from the description taken above, since the air-fuel ratio control system according to the invention is constructed and arranged so as to control the air-fuel ratio of the air-fuel mixture provided for the engine to a predetermined desired value in accordance with an air-fuel ratio sensed by admitting a part of an air-fuel mixture in the intake passageway into a space, by burning the admitted air-fuel mixture to form combustion gases and by sensing a parameter representative of a function of the concentration of a specific component in the combustion gases, the responsive ability or control speed of the air-fuel ratio control system is strikingly increased or the time required for control of the air-fuel ratio is strikingly reduced as compared with a conventional air-fuel ratio control system which controls the air-fuel ratio of an air-fuel mixture in accordance with an air-fuel ratio sensed in an exhaust system. An example of reduction in the time required for control of the air-fuel ratio is indicated in the following. That is, the time required from the beginning of control of the auxiliary air bleed passage 62 by operation of the control valve 64 to issuing of the resultant fuel from the main fuel nozzle 26 into the intake passageway 16 is below nearly 10 milliseconds. Although the time required for the flow of the air-fuel mixture from the main nozzle 26 to the sensor 68 in the combustion gas generator 32 depends upon the size of the combustion gas generator 32, it is about 10 milliseconds in the case of the generator 32 receiving a necessary minimum quantity of air-fuel mixture. The time necessary for the sensor 68 to sense the air-fuel ratio is about 20 milliseconds. Accordingly, the total time required is about 40 milliseconds and is reduced to about one fifth of the time required in the case of the conventional air-fuel ratio control system.

Also, the air-fuel ratio control system according to the invention makes a high degree of accuracy control and inspection of parts of the carburetor unnecessary so that production cost of the carburetor is reduced and mass production of the carburetor is made easy.

Furthermore, when the engine is in transitional condition such as starting, acceleration, or the like in which the operating condition varies greatly, the fuel economy, exhaust gas purifying, and output performances are increased because of the air-fuel ratio of the engine air-fuel mixture being controlled in accordance with the sensed air-fuel ratio with a minimized delay.

As the result of the air-fuel ratio control system according to the invention being constructed and arranged in such a manner that the exhaust gases emitted from the combustion gas generator 32 are returned into the intake passageway, the system has the following various advantages.

1. Measures are unnecessary which are necessary to the conventional air-fuel ratio control system, the combustion gases produced in the combustion gas generator of which are fed into the exhaust gas passageway, for maintaining the pressure of the combustion gases in the combustion gas generator of the conventional system at a sufficiently high level to make combustion of the extracted air-fuel mixture in the generator possible in spite of a high back pressure in the exhaust gas passageway and to at all times maintain stable combustion of the extracted air-fuel mixture without being influenced by variations in the pressure of engine exhaust gases due to variations in engine load.

2. Accordingly, the air-fuel mixture fed into the combustion chamber 36 of the combustion gas generator 32 is necessary only for sensing a parameter representative of a function of the air-fuel ratio of the air-fuel mixture and therefore the flow rate of the air-fuel mixture fed into the combustion chamber 36 may be extremely slight. Accordingly, for extraction of the air-fuel mixture into the combustion chamber 36, it is possible to utilize the pressure differential between portions of the intake passageway 16 upstream and downstream of the throttle valve 20 as described above with respect to and as shown in FIGS. 1 and 3. Also, when an electric motor operated pump is employed for the admission of the air-fuel mixture into a combustion gas generating space, a pump of small size can serve the purpose.

3. Even if the air-fuel mixture fed into the combustion gas generator 32 is not burned owing to a malfunction or the like, since the unburned air-fuel mixture emitted from the combustion gas generator 32 is drawn into and burned in a combustion chamber of the engine, the air-fuel ratio control system according to the invention does not exert on the engine and/or the atmosphere bad influences such as, for example, abnormal combustion of the unburned air-fuel mixture in the exhaust gas passageway and/or air pollution by the unburned air-fuel mixture.

4. Since the exhaust gases from the combustion gas generator 32 are fed into the engine, the air-fuel ratio control system provides an effect of reducing the production of nitrogen oxides (NOx) in the engine, although the degree of reduction is slight.

5. The air-fuel mixtures drawn into the engine and the combustion gas generator 32 are heated by the exhaust gases emitted from the combustion gas generator 32 to exert good influences on combustions of the air-fuel mixtures in the engine and the combustion gas generator 32, respectively.

What is claimed is:

1. A system in combination with an internal combustion engine for controlling the air-fuel ratio of an air-fuel mixture provided for the engine, the engine including:

an intake passageway providing communication between the atmosphere and the engine, and an air-fuel mixture producing device for producing an air-fuel mixture for the engine in the intake passageway, said system comprising:

a combustion gas generator defining a reaction chamber having an inlet port communicating with a portion of the intake passageway positioned downstream of a position in which the air-fuel mixture is produced, and an outlet port communicating with the intake passageway downstream of said portion, first means for admitting a part of the air-fuel mixture produced in the intake passageway into said reaction chamber through said inlet port, second means for burning the admitted air-fuel mixture in said reaction chamber for producing combustion gases therein, sensing means for sensing a parameter representative of the concentration of a specific component in said combustion gases which concentration is closely related to the air-fuel ratio of said admitted air-fuel mixture, third means for controlling the air-fuel ratio of an air-fuel mixture produced by the air-fuel mixture producing device to a desired value by controlling the flow rate of fuel, fed into the intake passageway for production of an air-fuel mixture, in accordance with the sensed parameter, and fourth means for feeding resultant gases of said combustion gases into the intake passageway downstream of said portion through said outlet port, said system further comprising a heating plate projecting from said outlet port of the reaction chamber into the intake passageway downstream of said position for heating an air-fuel mixture therein by heat of said combustion gases.

2. A system claimed in claim 1 in which the engine includes a throttle valve rotatably mounted in the intake passageway, said portion of the intake passageway being located upstream of the throttle valve, said first means comprising:

first passage means communicating with said portion of the intake passageway and with said inlet port of said reaction chamber, said fourth means comprising:

second passage means communicating with said outlet port of said reaction chamber and with the intake passageway downstream of the throttle valve.

3. A system as claimed in claim 1, in which said first means comprises first passage means communicating with said portion of the intake passageway and with said reaction chamber through said inlet port, and a pump which is located in said first passage means and which draws said part of said air-fuel mixture from said portion of the intake passageway and forces the drawn part of said air-fuel mixture into said reaction chamber, said fourth means comprising second passage means communicating with said reaction chamber through said outlet port and with the intake passageway downstream of said portion.

4. A system as claimed in claim 1, in which said first means comprises a burner for injecting into said reaction chamber the air-fuel mixture from the intake passageway, said second means comprising means for burning the air-fuel mixture injected from said burner to produce a flame directed from said burner into said reaction chamber.

5. A system as claimed in claim 1, in which said second means comprises a catalyst located in said reaction chamber, and heating means for heating said catalyst to its working temperature, said catalyst being arranged so that the air-fuel mixture admitted in said reaction chamber is passed through said catalyst and is oxidized by said catalyst to said combustion gases.

6. A system as claimed in claim 5, in which said heating means comprises an electric heater.

7. A system as claimed in claim 5, in which the engine includes an exhaust gas passageway for conducting exhaust gases of the engine to the atmosphere, and an exhaust gas recirculation (EGR) conduit communicating with the exhaust gas passageway and with the intake passageway for feeding a part of the engine exhaust gases thereinto, said heating means comprising a portion of the EGR conduit which is passed through said catalyst for heating same by heat of the engine exhaust gases.

8. A system as claimed in claim 1, in which said first means comprises passage means communicating with said inlet port of said reaction chamber and having an open end which opens into the intake passageway at a location adjacent to said heating plate for extracting an air-fuel mixture heated thereby.

9. A system as claimed in claim 1, in which said fourth means comprises flame barrier means located in said outlet port for preventing a flame produced in said reaction chamber from being fed into the intake passageway.

10. A system as claimed in claim 1, in which said reaction chamber is formed by an insulating material.

11. A system in combination with an internal combustion engine for controlling the air-fuel ratio of an air-fuel mixture provided for the engine, the engine including:

an intake passageway providing communication between the atmosphere and the engine, and an air-fuel mixture producing device for producing an air-fuel mixture for the engine in the intake passageway, said system comprising:

a combustion gas generator defining a reaction chamber having an inlet port communicating with a portion of the intake passageway positioned downstream of a position in which the air-fuel mixture is produced, and an outlet port communicating with the intake passageway downstream of said portion;

first means for admitting a part of the air-fuel mixture produced in the intake passageway into said reaction chamber through said inlet port;

second means for burning the admitted air-fuel mixture in said reaction chamber for producing combustion gases therein;

sensing means for sensing a parameter representative of the concentration of a specific component in said combustion gases which concentration is closely related to the air-fuel ratio of said admitted air-fuel mixture;

third means for controlling the air-fuel ratio of an air-fuel mixture produced by the air-fuel mixture producing device to a desired value by controlling the flow rate of fuel being fed into the intake passageway for production of an air-fuel mixture in accordance with the sensed parameter; and fourth means for feeding resultant gases of said combustion gases into the intake passageway downstream of said portion through said outlet port, in which the engine includes an exhaust gas passageway for conducting exhaust gases of the engine to the atmosphere, and an exhaust gas recirculation conduit communicating with the exhaust gas passageway and with the intake passageway for feeding a portion of the exhaust gases thereinto, said first and fourth means comprising an outlet portion of the exhaust gas recirculation conduit which is passed through said outlet port of said reaction chamber, said outlet portion of said exhaust gas recirculation conduit being surrounded by an internal wall surface of said outlet port to form therebetween a clearance and opening into the intake passageway in the same direction as that of said outlet port of said reaction chamber.

12. A system as claimed in claim 11, including a heating plate projecting from said outlet port of said reaction chamber into the intake passageway.

13. An air-fuel ratio control system in combination with an internal combustion engine, comprising:

means for supplying an air-fuel mixture to said engine, said supplying means including an intake passageway having a throttle valve therein for induction of the air-fuel mixture into said engine;

means, including a reaction chamber having inlet and outlet ports, for supplying a portion of the air-fuel mixture being inducted into said engine through said intake passageway into said reaction chamber through said inlet port and then feeding the portion of the air-fuel mixture into said intake passageway through said outlet port for induction into said engine;

means for effecting burning of the portion of the air-fuel mixture within said reaction chamber;

means for sensing a specific component in the portion of the air-fuel mixture;

control means controlled by said sensing means for adjusting the fuel flow and thereby the air-fuel ratio of the air-fuel mixture being inducted into said engine toward a predetermined value; and means, including a heating plate extending from said outlet port of said reaction chamber into said intake passageway, for heating the air-fuel mixture being inducted into said engine, for heating the air-fuel mixture by heat conducted to said heating plate from the product of burning the portion of the air-fuel mixture, said heating plate being exposed to the flow of the product of the portion of the air-fuel mixture into said intake passageway.

14. An air-fuel ratio control system as claimed in claim 13, wherein said burning means is in the form of a burner.

15. An air-fuel ratio control system as claimed in claim 14, wherein said inlet port of said reaction chamber communicates with an upstream portion of said throttle valve within said intake passageway and said outlet port of said reaction chamber communicates with a downstream portion of said throttle valve within said intake passageway whereby the portion of the air-fuel mixture being inducted into said engine is supplied to said reaction chamber through said inlet port and then fed into said intake passageway through said outlet port for induction into said engine.

16. An air-fuel ratio control system as claimed in claim 14, including a flame barrier means for preventing flame from entering said intake passageway.

17. An air-fuel ratio control system as claimed in claim 13, including a conduit extending from said inlet port of said reaction chamber to an area within said intake passageway in the proximity of said heating plate whereby the portion of the air-fuel mixture is heated by said heating plate before being supplied into said reaction chamber through said conduit and said inlet port.

18. An air-fuel ratio control system as claimed in claim 17, wherein said supplying and feeding means includes a pump for directing the portion of the air-fuel mixture toward said inlet port through said conduit.

19. An air-fuel ratio control system as claimed in claim 13, further comprising means for discharging exhaust gases from said engine, said discharging means including an exhaust gas passageway for discharge of the exhaust gases from said engine; and an exhaust gas recirculation conduit having one end communicating with said exhaust gas passageway and the other end communicating with said intake passageway, said outlet port opening into said intake passageway and said other end of said exhaust gas recirculation conduit being surrounded by said outlet port of said reaction chamber and opening into said intake passageway in the same direction as that of said outlet port whereby the portion of the air-fuel mixture is supplied to said reaction chamber through said inlet port and then fed into said intake passageway through said outlet port for induction into said engine.

20. An air-fuel ratio control system as claimed in claim 19, wherein a clearance is formed between said outlet port of said reaction chamber and said other end of said exhaust gas recirculation conduit so as to permit the flow of the portion of the air-fuel mixture toward said intake passageway from said reaction chamber.

21. An air-fuel ratio control system as claimed in claim 20, wherein said inlet and outlet ports of said reaction chamber are open to said intake passageway at portions disposed downstream of said throttle valve, respectively.

22. An air-fuel ratio control system as claimed in claim 21, wherein said burning effecting means includes a catalyst located in said reaction chamber.

23. An air-fuel ratio control system as claimed in claim 22, wherein a heating means is provided for heating said catalyst to its working temperature.

24. An air-fuel ratio control system as claimed in claim 23, wherein said heating means is in the form of an electric heater.

25. An air-fuel ratio control system as claimed in claim 21, wherein said exhaust gas recirculation conduit passes through said catalyst for heating purposes of said catalyst.

26. An air-fuel ratio control system as claimed in claim 24, wherein said reaction chamber is formed by an insulating material.

* * * * *